US008102352B2

(12) United States Patent
Lee

(10) Patent No.: US 8,102,352 B2
(45) Date of Patent: Jan. 24, 2012

(54) LIQUID CRYSTAL DISPLAY DEVICE AND DATA DRIVING CIRCUIT THEREOF

(75) Inventor: Jin-Sang Lee, Chungcheongbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 688 days.

(21) Appl. No.: 11/645,730

(22) Filed: Dec. 27, 2006

(65) Prior Publication Data

US 2008/0001888 A1 Jan. 3, 2008

(30) Foreign Application Priority Data

Jun. 30, 2006 (KR) ..... 10-2006-0061638

(51) Int. Cl.
*G09G 3/36* (2006.01)

(52) U.S. Cl. ..... 345/98; 345/87

(58) Field of Classification Search ..... 345/87, 345/96, 98, 100
See application file for complete search history.

(56) References Cited

U.S. PATENT DOCUMENTS

| | | | | |
|---|---|---|---|---|
| 5,856,818 | A * | 1/1999 | Oh et al. | 345/99 |
| 6,249,270 | B1 * | 6/2001 | Ito | 345/100 |
| 6,342,876 | B1 * | 1/2002 | Kim | 345/87 |
| 7,466,301 | B2 * | 12/2008 | Sohn et al. | 345/102 |
| 7,477,224 | B2 * | 1/2009 | Song et al. | 345/96 |
| 2003/0063079 | A1 * | 4/2003 | Abe et al. | 345/204 |

* cited by examiner

*Primary Examiner* — Quan-Zhen Wang
*Assistant Examiner* — Calvin C Ma
(74) *Attorney, Agent, or Firm* — Morgan, Lewis & Bockius LLP

(57) ABSTRACT

A liquid crystal display device includes a liquid crystal panel, a timing controller providing an enable signal to output a digital image data, a data driver converting the digital image data into an analog image signal, and a polarity generator in the data driver for dividing a frequency of the enable signal to generate a polarity control signal for changing the polarity of the analog image data at each rising edge of the enable signal.

4 Claims, 6 Drawing Sheets

FIG. 7

| PARAMETER | SYMBOL | CONDITION | MIN | TYP | MAX | UNIT |
|---|---|---|---|---|---|---|
| CLOCK PERIOD | PWCLK | - | 6.4 | - | - | NS |
| CLOCK HIGH-DURATION | PWCLK(H) | | 2.4 | - | - | |
| CLOCK LOW-DURATION | PWCLK(L) | | 2.4 | - | - | |
| DATA SETUP TIME | TSETUP1 | | 1.2 | - | - | |
| DATA HOLD TIME | THOLD1 | | 1.2 | - | - | |
| START PULSE SETUP TIME | TSETUP2 | | -1.0 | - | - | |
| START PULSE DELAY | TPLH1 | CL=25PF | - | 16 | 24 | NS |
| CLK,LV0,TO LV5 RISE TIME | TR | - | - | - | 1.5 | NS |
| CLK,LV0,TO LV5 FALL TIME | TF | - | - | - | 1.5 | NS |
| DRIVER OUTPUT DELAY1 | TPHL1 | CL=110PF(1)(3) | - | - | 3 | US |
| DRIVER OUTPUT DELAY2 | TPHL2 | CL=110PF(2)(3) | - | - | 9 | |
| RESET(RST) HIGH-DURATION | PWRST | OVER 50NS | 3 | - | - | CLK |
| CLK1 HIGH-DURATION | TPWCLK1 | - | 0.2 | - | - | US |
| POL SETUP TIME | TPOL-CLK1 | - | -5.0 | | | NS |
| POL HOLD TIME | TCLK1-POL | - | 3.0 | | | NS |
| RECEIVER OFF TO CLK1 TIME | TLDT | - | 5.0 | - | - | CLK |
| CLK1 TO RST INPUT TIME | TCLK1-RST | - | 200 | - | - | NS |
| RESET LOW TO CLK1 RISE TIME | TRST-CLK1 | - | 0 | - | - | |

LIQUID CRYSTAL DISPLAY DEVICE AND DATA DRIVING CIRCUIT THEREOF

This application claims the benefit of Korean Patent Application No. 10-2006-0061638, filed on Jun. 30, 2006, which is hereby incorporated by reference in its entirety

BACKGROUND OF THE INVENTION

1. Field of the Invention

Embodiments of the present invention relate to a liquid crystal display (LCD) device, and more particularly, to a data driving circuit for an LCD device. Embodiments of the present invention are suitable for a wide scope of applications. In particular, embodiments of the present invention are suitable for providing a simpler controller to generate a polarity control signal for the LCD device.

2. Description of the Related Art

In general, an LCD device includes a liquid crystal panel. The liquid crystal panel includes a first substrate including a pixel electrode, a second substrate including a common electrode, and a liquid crystal layer placed between the first and second substrates. The liquid crystal molecules forming the liquid crystal layer have a dielectric anisotropy property.

A voltage is applied between the pixel electrode and the common electrode to form an electric field in the liquid crystal layer to control the arrangement of the liquid crystal molecules. Accordingly, the transmittance of light passing through the liquid crystal layer can be controlled with the electric field to display a desired image. However, an extended application of the electric field in one direction in the liquid crystal layer may lead to image quality deterioration. The polarity of the data voltage applied to the pixel electrode with respect to a common voltage applied to the common electrode is inverted frame-by-frame, line-by-line or dot-by-dot.

FIG. 1 shows a block diagram of a driving system of an LCD device according to the related art. Referring to FIG. 1, the LCD device includes an interface part 10 receiving red (R), green (G), and blue (B) data, and control signals from a drive system (not shown), such as a personal computer (PC), and supplies the R, G, and B data and the control signals to a timing controller 12. Here, the control signals may include an input clock, a horizontal synchronizing signal (Hsync), a vertical synchronizing signal (Vsync), and a data enable signal (DE), etc. A low voltage differential signal (LVDS) interface and a transistor-transistor logic (TTL) interface are widely used for data and control signal transmission to the drive system. Also, such interfaces may be integrated into a single chip together with the timing controller 12.

The timing controller 12 uses the control signal from the interface part 10 to generate control signals for driving a data driver 18 including a plurality of drive ICs (not shown) and a gate driver 20 including a plurality of gate drive ICs (not shown). Also, input data from the interface part 10 is transmitted to the data driver 18.

A reference voltage generator 16 generates reference voltages for a digital-to-analog converter (DAC) within the data driver 18. The reference voltages are established by a producer on the basis of a transmittance-to-voltage characteristic of the LCD panel.

The data driver 18 selects reference voltages from the reference voltage generator 16 in accordance with the input data in response to the control signals from the timing controller 12. The data driver 18 performs conversion of the input data into analog image signals, and supplies the converted analog image signals to a liquid crystal panel 22.

The gate driver 20 switches ON/OFF the gate terminals of thin film transistors (TFT) arranged on the liquid crystal panel 22 line-by-line in response to the control signals input from the timing controller 12. Also, the gate driver 20 transfers the analog image signals from the data driver 18 to pixels connected to the thin film transistors, respectively.

A power voltage generator 14 supplies operating power for each of components, generates a common electrode voltage of the liquid crystal panel 22, and supplies the common electrode voltage.

In the configuration described above, the timing controller 12 generates predetermined control signals for driving of the LCD device, in response to the input control signals. That is, the timing controller 12 generates a control signal in accordance with a clock based on the edge of a horizontal synchronizing signal (Hsync) or a data enable signal (DE). The output signals from the timing controller 12 may differ from each other according to types of data drive ICs and gate drive ICs.

Types and timing of control signals used in common will now be described. Control signals for the data driver include a source sampling clock (SSC), a source output enable (SOE), a source start pulse (SSP), a polarity reverse (POL), a data reverse (REV), and an odd/even data signals, etc. The SSC signal is used as a sampling clock to latch data in the data driver 18 and determines a driving frequency of a data drive IC. The SOE signal transfers data latched by the SSC signal to the liquid crystal panel. The SSP signal is a signal that notifies a latch and sampling initiation of data during one horizontal synchronous period. The POL signal indicates the positive/negative polarity of the liquid crystals to make an inversion driving of the liquid crystals. The REV signal is a signal that selects the polarity of the transferred data. The odd/even data signal distinguishes between an odd data corresponding to an odd-numbered pixel, and an even data corresponding to an even-numbered pixel.

FIG. 2 shows a timing diagram of the operation of the data driver of FIG. 1 in response to a control signal. Referring to FIG. 2, if the data driver recognizes a "high" input of the SSP signal at the rising and falling edges of the SSC signal, then the data driver latches input data in response to the SSC signal. Thereafter, the latched data is decoded into an analog output voltage in response to the SOE signal and supplies the analog output voltage to the liquid crystal panel. Here, a positive decoder output voltage higher than a common electrode voltage is selected when the POL signal is a "high" state, while a negative decoder output voltage lower than the common electrode voltage is selected when the POL signal is a "low" state. Accordingly, the driving of the liquid crystal panel is inverted between positive and negative polarities.

Control signals for the gate driver include a gate shift clock (GSC), a gate output enable (GOE), and a gate start pulse (GSP) signals, etc. The GSC signal determines a time when a gate of the TFT is turned on or off. The GOE signal controls output of the gate driver. The GSP signal indicates a first drive line of the field in one vertical synchronizing signal.

FIG. 3 is shows a timing diagram of the operation of the gate driver of FIG. 1 in response to a control signal. First, the gate driver recognizes a "high" state of the GSP signal at the rising or falling edge of the GSC signal to output a gate signal maintaining a "high" state during about one period of the GSC signal. Here, the GOE signal is combined with the output gate signal to disable an output correspond to a "high" width of the GOE signal.

The aforementioned related art configuration has the following problems. First, the purpose of the inversion driving of the liquid crystal panel between positive and negative polarities is to prevent deterioration of the liquid crystal material.

However, this periodic polarity inversion of the data voltage causes an asymmetry in a pixel voltage of a liquid crystal capacitor, which results in severe flickering.

Also, the size of the timing controller is increased to allow the timing controller to generate various control signals and rearrange externally provided data, and transfer signals between the timing controller and the plurality of drive ICs become complicated. Accordingly, the number of signal lines increases.

BRIEF DESCRIPTION OF THE INVENTION

Accordingly, the present invention is directed to a liquid crystal display device and a data driving circuit thereof that substantially obviate one or more of the problems due to limitations and disadvantages of the related art, and a liquid crystal display device using the same.

An object of the present invention is to provide a data driving circuit capable of preventing a flicker caused by an asymmetry in an LCD device.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a liquid crystal display device includes a liquid crystal panel, a timing controller providing an enable signal to output a digital image data, a data driver converting the digital image data into an analog image signal, and a polarity generator in the data driver for dividing a frequency of the enable signal to generate a polarity control signal for changing the polarity of the analog image data at each rising edge of the enable signal.

In another aspect, a data driving circuit for a liquid crystal display device includes a data register temporarily storing digital video data, a first latch latching the digital video data from the data register in response to a sampling signal, a second latch latching the digital data input from the first latch and outputting the latched data simultaneously in response to an enable signal, a polarity generator for dividing a frequency of the enable signal to generate a polarity control signal, and a digital-to-analog converter for outputting a gray-scale voltage corresponding to the latched data from the second latch in accordance with the polarity control signal.

In another aspect, a liquid crystal display device includes a timing controller providing an enable signal to output a digital image data, and a data driver converting the digital image data into an analog image signal for display on the liquid crystal display device, wherein the data driver switches a polarity of the analog image signal at half a frequency of the enable signal.

Both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiments of the present invention and together with the description serve to explain the principle of embodiments of the present invention. In the drawings:

FIG. 7 shows an exemplary data sheet for the D-flip-flop of FIG. 6A.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
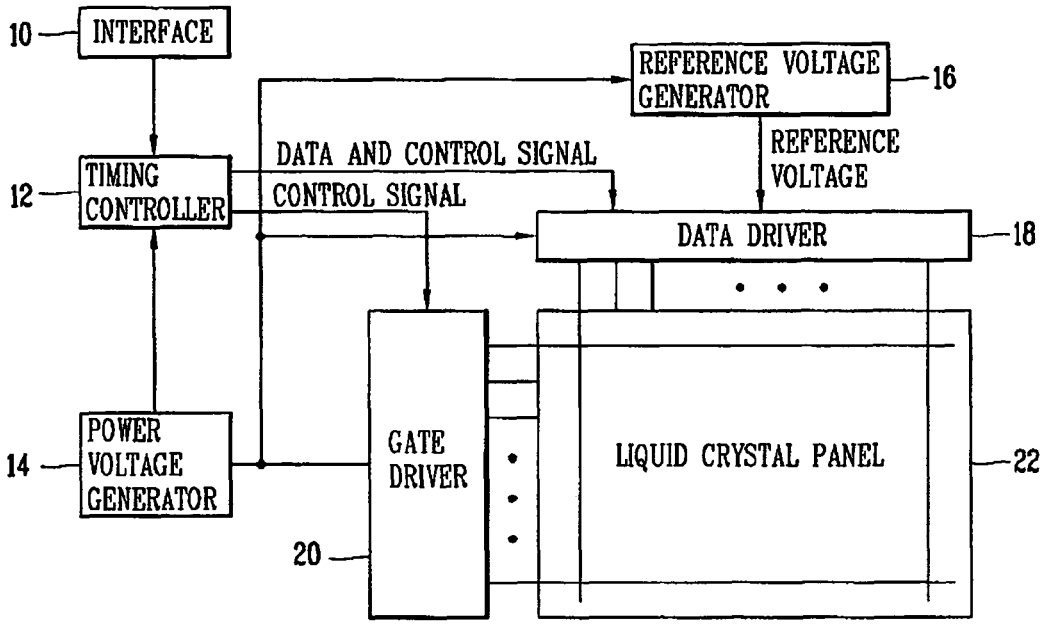
FIG. 1 RELATED ART
FIG. 1 shows a block diagram of a driving system of an LCD device according to the related art.
Figure 2:
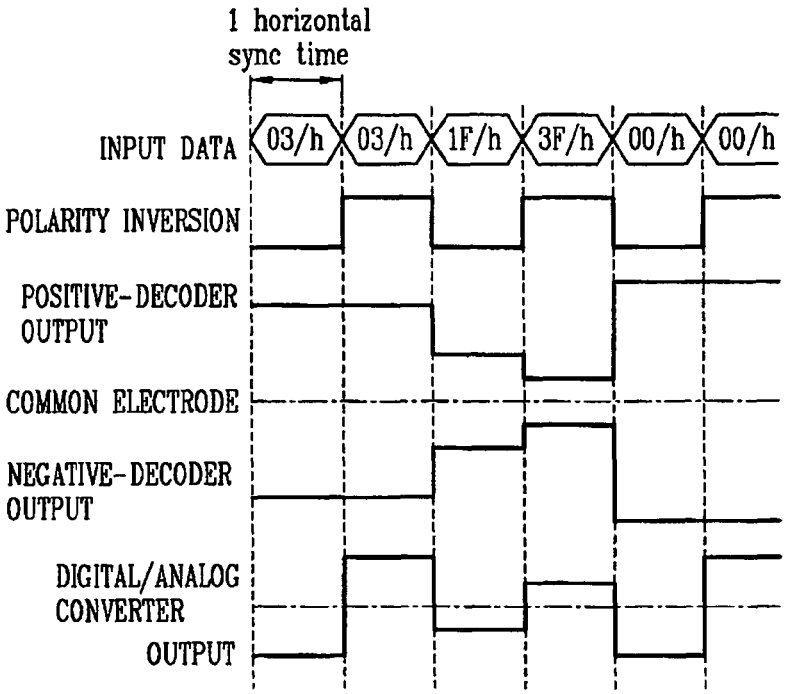
FIG. 2 RELATED ART
FIG. 2 shows a timing diagram of the operation of the data driver of FIG. 1 in response to a control signal.
Figure 3:
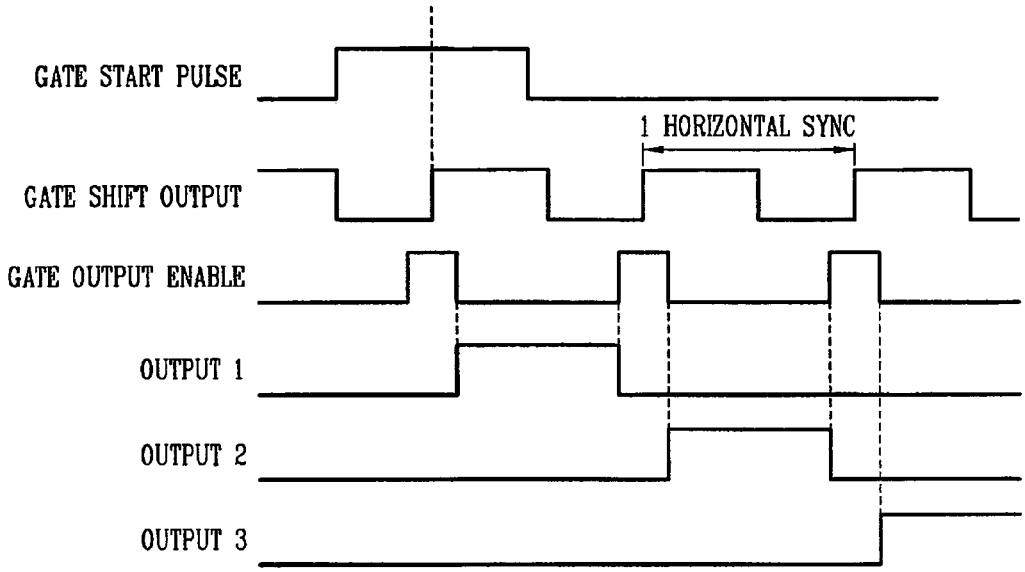
FIG. 3 RELATED ART
FIG. 3 is shows a timing diagram of the operation of the gate driver of FIG. 1 in response to a control signal.
Figure 4:
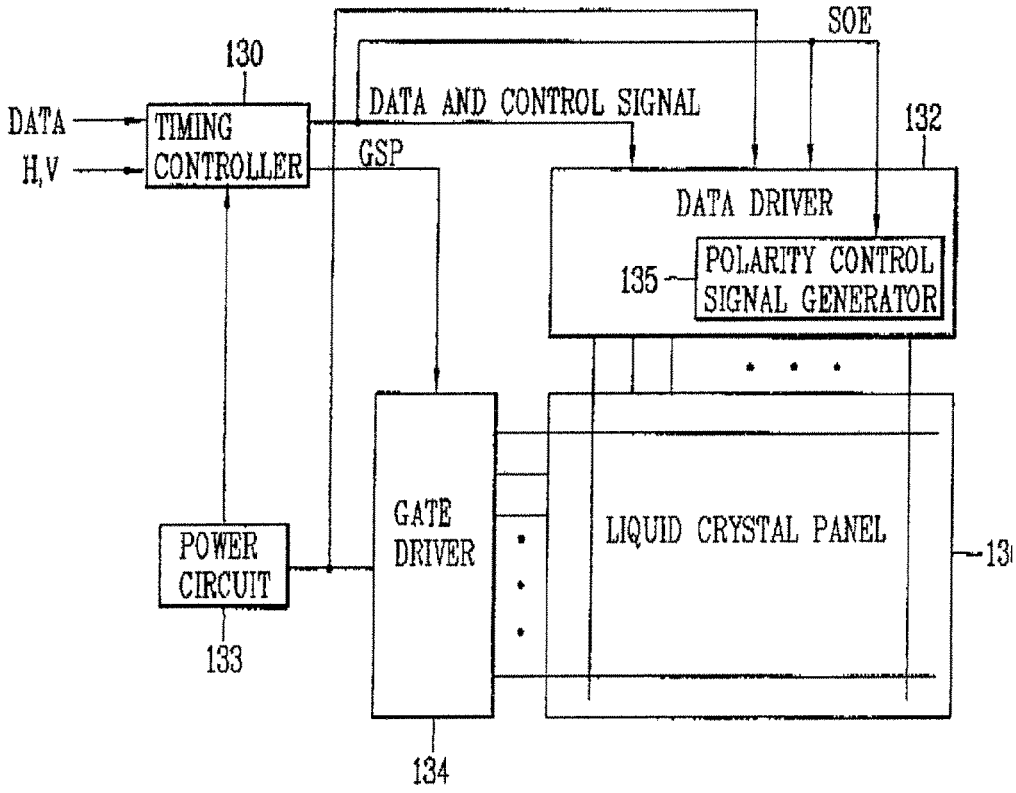
FIG. 4 shows a block diagram of an exemplary driving system of an LCD device according to an embodiment of the present invention.

FIG. 4 shows a block diagram of an exemplary driving system of an LCD device according to an embodiment of the present invention. Referring to FIG. 4, the LCD device includes a timing controller 130 receiving input data (DATA) from an external system (not shown), such as a graphic card supplying digital video data to be displayed on the LCD device. The graphic card converts video data corresponding a resolution of the LCD device, and outputs the converted video data to the LCD device. The video data may include red (R), green (G) and blue (B) data. Also, the graphic card generates control signals such as a clock signal (DCLK), and horizontal and vertical synchronizing signals (Hsync and Vsync) in accordance with the resolution of the LCD device.

A power circuit 133 generates driving voltages for driving the LCD device, such as a gate voltage, a gamma reference voltage, and a common voltage, etc by using a voltage input from a system power unit of the system driver (not shown). Also, the power circuit 133 supplies the generated driving voltages to the timing controller 130, a data driver 132, a gate driver 134, and a gamma circuit (not shown).

The timing controller 130 transfers the R, G and B video data to the data driver 132. Also, the timing controller 130 generates control signals, such as timing signals for controlling the timing of the data and gate drivers 132 and 134.

The gate driver 134 switches ON/OFF the gate terminals of switching elements, such as TFTs, on a liquid crystal panel 136 line-by-line in response to the control signals input from the timing controller 130. Also, the gate driver 134 transfers analog image signals from the data driver 132 to pixels connected to the TFTs, respectively.

The data driver 132 selects reference voltages according to the input R, G and B data in response to the control signals input from the timing controller 130, and performs conversion thereof into analog image signals. The data driver 132 supplies the converted analog image signals to the liquid crystal panel 136. Here, the data driver 132 includes one or more data driver IC, which may include a D-flip-flop (D-FF, not shown). A source output enable (SOE) signal from the timing controller 130 is provided to a clock input terminal CLK of the D-FF. The D-FF generates a polarity control POL signal at an output terminal (Q) thereof and applies the POL signal to a digital analog converter (DAC). The D-FF and the data driver 132 may be formed on a PCB.

The liquid crystal panel 136 includes TFTs formed at crossings of an n-number of gate lines GL1~GLn and an m-number of data lines DL1~DLm, and liquid crystal cells connected to the TFTs and arranged in a matrix. The TFT supplies a video signal from one of the data lines DL1~DLm to the liquid crystal cell in response to a gate pulse from the gate lines. The liquid crystal cell includes a common electrode and a pixel electrode connected to the TFT and facing each other with liquid crystals therebetween. Thus, the liquid crystal cell may be equivalently expressed by a liquid crystal capacitor (Clc). The liquid crystal cell includes a storage capacitor connected to a previous gate line to sustain a data voltage charged in the liquid crystal capacitor (Clc) until the next data voltage is charged.

Figure 5A:
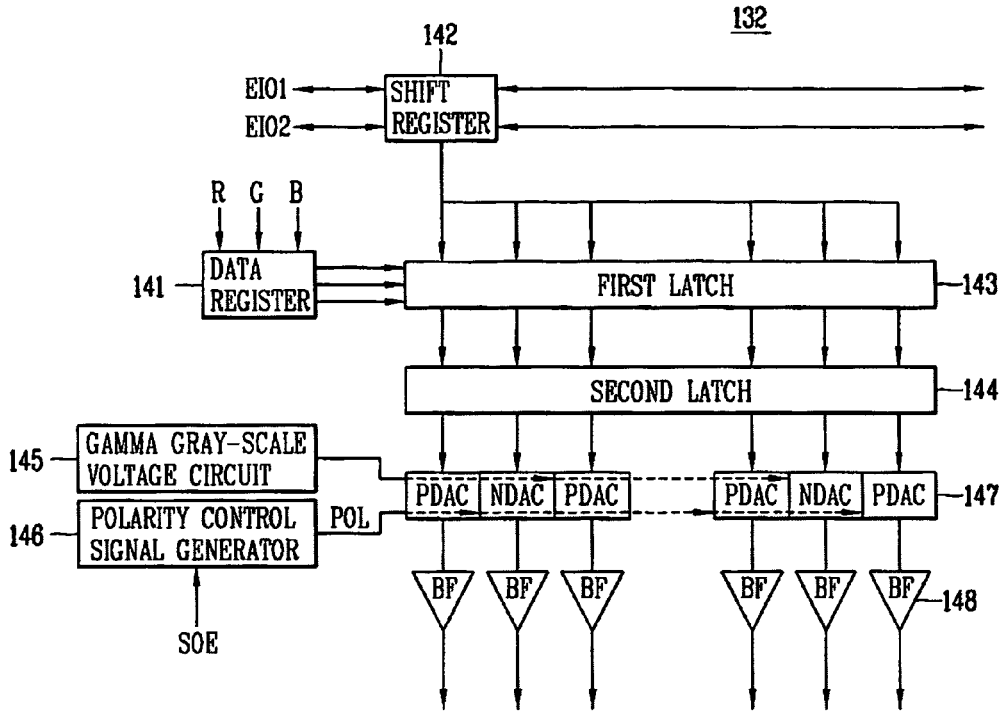
FIG. 5A shows a block diagram of an exemplary data driver for the LCD device of FIG. 4.

FIG. 5A shows a block diagram of an exemplary data driver for the LCD device of FIG. 4. Referring to FIG. 5A, a data register 141 temporarily stores R, G and B data from the timing controller 130, and supplies the stored R, G and B data to a first latch 143.

A shift register 142 shifts a source start pulse (SSP) signal from the timing controller 130 according to a source sampling clock (SSC) signal to generate a sampling signal. Also, the shift register 142 shifts the source start pulse (SSP) signal to transfer a carry signal (CAR) to the next register 142.

The first latch 143 samples R, G and B digital video data from the data register 141 in response to the sampling signal sequentially input from the shift register 142 and latches the R, G and B digital video data line-by-line.

A second latch 144 latches the R, G and B digital video data from the first latch 143, and then, simultaneously outputs the latched R, G and B digital video data in response to a source output enable (SOE) signal from the timing controller.

A gamma gray-scale voltage circuit 145 re-divides gamma reference voltages, which were initially divided by a reference voltage generator, using a voltage input from a power voltage generator 133, and generates gamma gray-scale voltages corresponding to respective gray levels.

A polarity control signal generator 146 simultaneously receives the SOE signal from the timing controller 133 through the second latch 144, and generates a polarity control signal (POL).

A DAC 147 outputs a gray-scale voltage of a corresponding level output from the gamma gray-scale voltage circuit 145 in response to the R, G and B digital video data from the second latch 144. The gray-scale voltage is any one of a positive (+) voltage and a negative (−) voltage in accordance with the POL signal from the polarity control signal generator 146. An output circuit 148 stores analog R, G and B pixel voltages selected and output by the DAC 147.

Figure 5B:
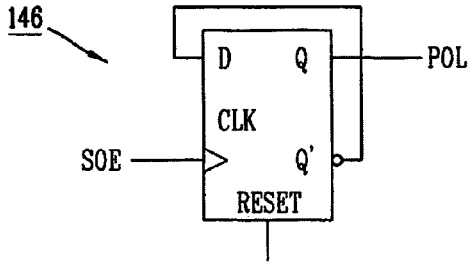
FIG. 5B shows an exemplary polarity control signal generator for the data driver of FIG. 5A.

FIG. 5B shows an exemplary polarity control signal generator for the data driver of FIG. 5A. Referring to FIG. 5B, the polarity control signal generator 146 includes a D-FF. The control input terminal D of the D-FF is connected to the inversion output terminal Q' of the D-FF. The SOL signal is provided at the CLK input of the D-FF. The POL signal is outputted at the non-inverting output terminal Q of the D-FF. In an embodiment, a positive edge trigger type D-FF is used. In another embodiment, another type of D-FF may be used.

Figure 5C:
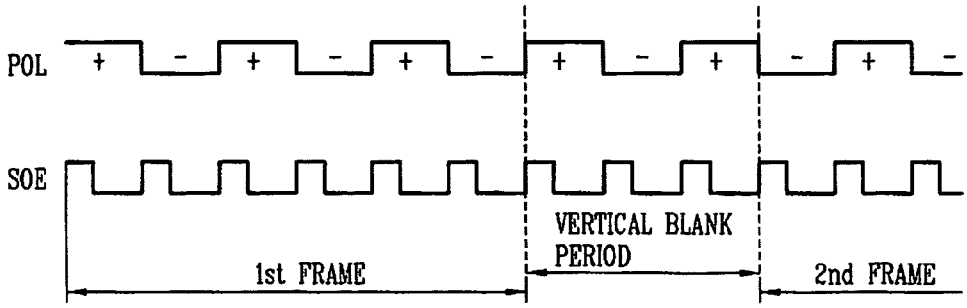
FIG. 5C shows exemplary timing waveforms of POL and SOL signals in the data driver of FIG. 5A.

FIG. 5C shows exemplary timing waveforms of POL and SOL signals in the data driver of FIG. 5A. Referring to FIG. 5C, the SOE signal from the timing controller 130 to the second latch 144 is concurrently provided to a clock input terminal CLK of the D-FF 146. The D-FF generates the POL signal by a half-frequency division of the SOE signal. Accordingly, the POL signal changes states between high and low at each rising edge of the SOE signal. Thus, the polarity of the analog image data from the data driver 132 is changed from a positive polarity to a negative polarity, or vice versa, at each rising edge of the enable signal.

In an embodiment, eight pulses of the SOE signal correspond to one frame output in an LCD having a 4×8 resolution. An odd number of pulses of the SOE signal are added in every vertical blank period of the SOE signal for enabling frame inversion.

Figure 6A:
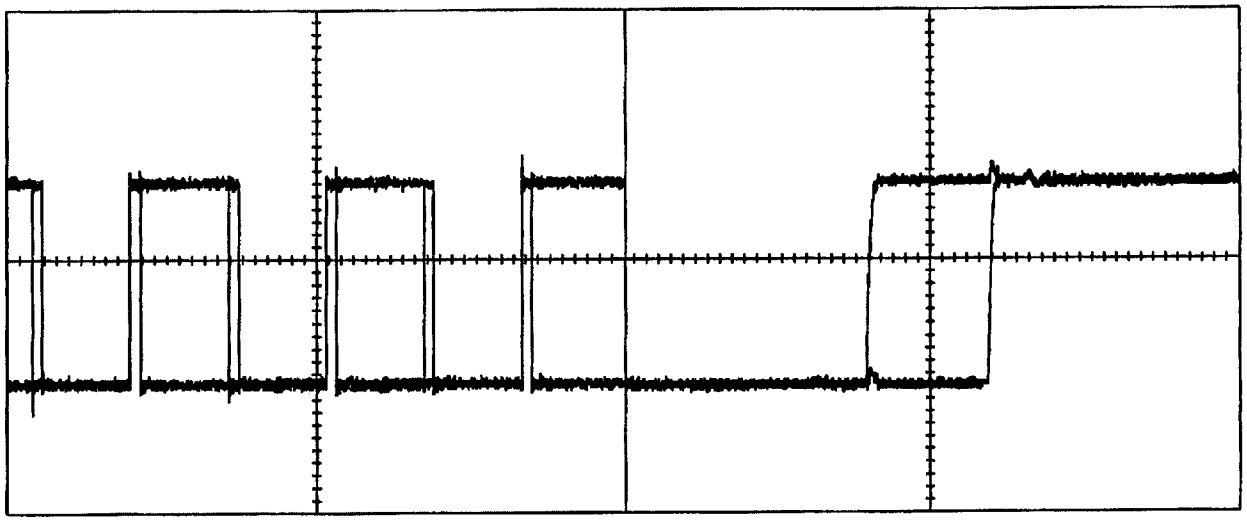
FIG. 6A shows exemplary timing waveforms of POL and SOL signals using an external polarity control signal generator in FIG. 5A.
Figure 6B:
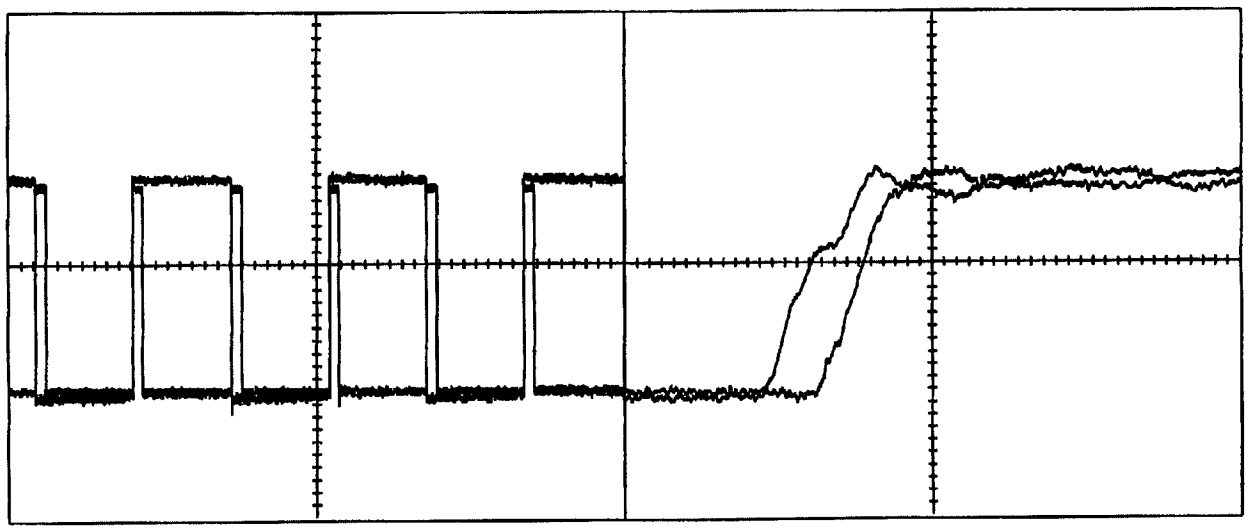
FIG. 6B RELATED ART
FIG. 6B shows timing waveforms of POL and SOL signals according to the related art.

FIG. 6A shows exemplary timing waveforms of POL and SOL signals using an external polarity control signal generator in FIG. 5A. FIG. 6B shows timing waveforms of POL and SOL signals according to the related art. Referring to FIG. 6A, the POL signal is generated using an externally provided D-FF. In comparison, the POL signal generated in the related art is unstable.

FIG. 7 shows an exemplary data sheet for the D-flip-flop of FIG. 6A. Referring to FIG. 7, a delay time falls within a tolerance range specified by data driver IC manufactures. Thus, mounting of the D-FF in the data drive IC at the time of manufacturing would improve the result waveform of FIG. 6A.

In accordance with an embodiment of the invention, a reduction of pins of the timing controller and signal lines between the timing controller and the data driver can be achieved, thereby simplifying the design of a main PCB.

It will be apparent to those skilled in the art that various modifications and variations can be made in embodiments of the present invention. Thus, it is intended that embodiments of the present invention cover the modifications and variations of the embodiments described herein provided they come within the scope of the appended claims and their equivalents.

What is claimed is:

1. A liquid crystal display device, comprising:

a liquid crystal panel;

a timing controller providing an enable signal to output a digital image data;

a data driver converting the digital image data into an analog image signal; and a polarity generator formed within the data driver which receives a source output enable (SOE) signal of the timing controller and divides a frequency of the signal into ½ to thus generate a polarity control signal, wherein the data driver includes:

a shift register shifting a source start pulse input from the timing controller in response to a source sampling clock to generate a sampling signal;

a data register temporarily storing the digital image data from the timing controller, and supplying the digital image data to a first latch, the first latch latching the digital image data line-by-line in response to the sampling signal sequentially input from the shift register;

a second latch latching the digital image data input from the first latch, and outputting the latched data simultaneously in response to the enable signal from the timing controller;

a gray-scale voltage generator generating gray-scale voltages of a positive polarity and a negative polarity for dividing an externally provided reference voltage;

a digital-to-analog converter selecting a gray-scale voltage from the gray-scale voltage generator corresponding to the digital image data input from the second latch in response to the polarity control signal; and an output unit for buffering a pixel voltage signal from the digital-to-analog converter.

2. The liquid crystal display device of claim 1, wherein the enable signal includes an odd number of pulses in a vertical blank period to enable a frame inversion.

3. The liquid crystal display device of claim 1, wherein the polarity generator includes a D-flip-flop provided with the enable signal at a clock input terminal thereof.

4. The liquid crystal display device of claim 1, wherein the polarity generator includes a D-flip-flop with a control input terminal and an output terminal electrically connected to each other.

* * * * *